US006537327B2

(12) United States Patent
Rodrigues

(10) Patent No.: US 6,537,327 B2
(45) Date of Patent: Mar. 25, 2003

(54) TEXTILE MANUFACTURING AND TREATING PROCESSES COMPRISING A HYDROPHOBICALLY MODIFIED POLYMER

(75) Inventor: Klein A. Rodrigues, Signal Mountain, TN (US)

(73) Assignee: National Starch and Chemical Investment Holding Corporation, New Castle, DE (US)

( * ) Notice: Subject to any disclaimer, the term of this patent is extended or adjusted under 35 U.S.C. 154(b) by 0 days.

(21) Appl. No.: 09/881,269

(22) Filed: Jun. 14, 2001

(65) Prior Publication Data

US 2001/0034911 A1 Nov. 1, 2001

Related U.S. Application Data

(62) Division of application No. 09/441,714, filed on Nov. 16, 1999.

(51) Int. Cl.[7] ..... D06M 13/402; D06M 13/165
(52) U.S. Cl. ..... 8/194; 8/116.1
(58) Field of Search ..... 8/194, 116.1

(56) References Cited

U.S. PATENT DOCUMENTS

| | | | | | |
|---|---|---|---|---|---|
| 3,717,689 | A | * | 2/1973 | Tanaka et al. | 260/898 |
| 4,531,946 | A | | 7/1985 | Christie et al. | 8/192 |
| 4,795,793 | A | * | 1/1989 | Amimoto et al. | 526/243 |
| 4,814,514 | A | * | 3/1989 | Yokota et al. | 568/608 |
| 5,002,686 | A | * | 3/1991 | Guth et al. | 252/174.16 |
| 5,147,576 | A | | 9/1992 | Montague et al. | 252/174 |
| 5,429,754 | A | * | 7/1995 | Lin et al. | 252/8.6 |
| 5,484,840 | A | | 1/1996 | Binkley | 524/501 |
| 6,191,244 | B1 | | 2/2001 | Lau et al. | 526/328.5 |
| 6,225,242 | B1 | | 5/2001 | Lau et al. | 442/83 |

* cited by examiner

*Primary Examiner*—John Hardee
(74) *Attorney, Agent, or Firm*—Thomas F. Roland, Esq.

(57) ABSTRACT

A method to prevent the backstaining of denim during a stonewashing process comprising treating the denim with a solution or dispersion of a hydrophobically modified polymer having a hydrophilic backbone and at least one hydrophobic moiety, wherein said hydrophilic backbone is prepared from at least one monomer selected from the group consisting of ethylenically unsaturated hydrophilic monomer selected from the group consisting of amide, ether, alcohol, aldehyde, anhydride, ketone and ester; polymerizable hydrophilic cyclic monomer; non-ethylenically unsaturated polymerizable hydrophilic monomer which is selected from the group consisting of glycerol and other polyhydric alcohols; and combinations thereof, wherein said hydrophilic backbone is optionally substituted with one or more amino, amine, amide, sulfonate, sulfate, phosphonate, hydroxy, carboxyl or oxide groups; wherein said hydrophobic moiety is prepared from at least one hydrophobic monomer or a chain transfer agent, said hydrophobic monomer is selected from the group consisting of a siloxane, hydrophobic alkoxygroup, alkyl sulfonate, aryl sulfonate, and combinations thereof, and said chain transfer agent has 1 to 24 carbon atoms and is selected from the group consisting of a mercaptan, amine, alcohol, and combinations thereof, wherein said hydrophobically modified polymer is present in an amount of from 0.001 to 50 weight percent, based on the total weight of the solution or dispersion.

3 Claims, No Drawings

TEXTILE MANUFACTURING AND TREATING PROCESSES COMPRISING A HYDROPHOBICALLY MODIFIED POLYMER

This application is a divisional of pending application Ser. No. 09/441,714 filed Nov. 16, 1999.

FIELD OF THE INVENTION

This invention relates to textile manufacturing and treating processes comprising hydrophobically modified polymers. The polymers are especially useful in preventing the backstaining of denim during a stonewashing process.

BACKGROUND OF THE INVENTION

The production of "aged" denim garments is obtained by nonhomogeneous removal of indigo dye trapped inside the fibers by the cooperative action of cellulase enzymes and mechanical factors such as beating and friction. However, when cellulases are present, the removed indigo backstains the reverse side of the fabric which is undesirable.

WO 9325655 describes enzymatic compositions for stonewashing. Indigo backstaining which occurs in the presence of cellulase enzymes is described in an article entitled, "*Indigo Backstaining During Cellulase Washing*" Cavaco-Paulo et al., Textile Res. J. 68(6), 398–401 (1998).

Conventional anti-dye transfer polymers such as polyvinylpyrrolidone and polyvinylpyrridine-N-oxide are effective for preventing the redeposition of direct dyes that are typically used on cotton. However, such conventional anti-dye transfer polymers are not effective in preventing the backstaining of indigo dyes due to the extreme hydrophobicity of indigo dyes.

Discoloration is also a problem in textile bleaching processes wherein heavy metal ions and salts are present. For example, bleaching by hydrogen peroxide is generally carried out under an alkaline condition of a pH value of 10 to 14, and the reaction effectively improving the whiteness is represented by the formula: $H_2O_2 \rightarrow HO^-_2 + H^+$, the active bleaching component is the perhydroxyl ion. However, under alkaline conditions (pH of at least 10), the side reaction represented by the formula: $2H_2O_2 \rightarrow 2H_2O + O_2$ is promoted by heavy metal ions which are contained in cellulose fibers of cotton, flax or the like, and in a bleaching bath, such as iron, calcium, copper and manganese, and therefore, discoloration of the fibers occurs, and the fibers are made brittle.

To eliminate this disadvantage, sodium silicate is frequently used as a bleach stabilizer, but the use of sodium silicate is disadvantageous in that water-insoluble salts of calcium and magnesium, i.e., silicate scales, are formed, and these insoluble salts adhere to and are deposited on a bleached textile and a bleaching apparatus to cause a silicate scale problem.

Bleach stabilizers other than sodium silicate include polyphosphoric acid salts such as sodium tripolyphosphate, and aminocarboxylate organic chelating agents such as ethylenediamine-tetraacetic acid (EDTA) and diethylenetriamine-pentaacetic acid (DTPA). These bleach stabilizers do not cause a silicate scale problem, however, at a pH of 10 to 14, the chelating capacity is reduced. Moreover, these bleach stabilizers are insolubile in the presence of an excessive amounts of hardness ions.

Heavy metal ions also cause problems in the desizing, scouring, mercerising, and dyeing processes of textiles by forming insoluble salts. The insoluble salts deposit on textiles and equipment causing scale problems and blemishes on textiles.

SUMMARY OF THE INVENTION

The present invention provides a textile manufacturing or treating process comprising treating a textile with a solution or dispersion of a hydrophobically modified polymer having a hydrophilic backbone and at least one hydrophobic moiety, wherein said hydrophilic backbone is prepared from at least one monomer selected from the group consisting of ethylenically unsaturated hydrophilic monomer selected from the group consisting of unsaturated $C_1$–$C_6$ acid, amide, ether, alcohol, aldehyde, anhydride, ketone and ester; polymerizable hydrophilic cyclic monomer; non-ethylenically unsaturated polymerizable hydrophilic monomer which is selected from the group consisting of glycerol and other polyhydric alcohols; and combinations thereof, wherein said hydrophilic backbone is optionally substituted with one or more amino, amine, amide, sulfonate, sulfate, phosphonate, hydroxy, carboxyl or oxide groups;

wherein said hydrophobic moiety is prepared from at least one hydrophobic monomer or a chain transfer agent, said hydrophobic monomer is selected from the group consisting of a siloxane, saturated or unsaturated alkyl and hydrophobic alkoxygroup, aryl and aryl-alkyl group, alkyl sulfonate, aryl sulfonate, and combinations thereof, and said chain transfer agent has 1 to 24 carbon atoms and is selected from the group consisting of a mercaptan, amine, alcohol, and combinations thereof, wherein said hydrophobically modified polymer is present in an amount of from 0.001 to 50 weight percent, based on the total weight of the solution or dispersion.

According to another aspect, the invention provides a method to prevent the backstaining of denim during a stonewashing process comprising adding 0.001 to 50 weight percent, based on the total weight of the solution or dispersion, of a solution or dispersion of the hydrophobically modified polymer.

The hydrophobically modified polymers prevent redeposition of indigo onto denim in a stonewashing process, help stabilize hydrogen peroxide in a bleaching process, reduce scale and prevents deposition of heavy metal ions such as iron, calcium and magnesium in a scouring, desizing, and mercerising process, and disperse direct and disperse dyes, and suspend unfixed dyes in order to provide a consistent and level dyeing of textiles in a dyeing process.

An additional advantage is that the hydrophobically modified polymers complex salts, such as calcium, magnesium and iron salts, during the dyeing process which prevents the salts from depositing on the textiles and causing blemishes, or precipitating the dyes out of solution which reduces the efficiency of the dyes. The hydrophobically modified polymers also suspend polyester trimers during the dyeing of polyester.

DESCRIPTION OF THE INVENTION

The invention provides a textile manufacturing or treating process comprising a solution or dispersion of a hydrophobically modified polymer. Such textile manufacturing and treating processes include stonewashing of denim, desizing, scouring, mercerising, bleaching, and dyeing processes. As used herein, these terms have the following meanings:

(1) "Stonewashing" refers to the production of "aged" denim garments with cellulase enzymes in the presence of mechanical factors such as beating and friction.

(2) "Desizing" is essentially a part of the scouring process, and rapid removal of size is important especially in continuous preparation processes. Desizing of sized fabrics is commonly carried out using water washing at varying temperatures or with enzymes. Desizing can also be carried out effectively with alkaline, preferably caustic solutions, and those alkaline solutions can be very dilute.

(3) "Scouring" involves removing or reducing the level of fats, waxes, oils, dirt, and so forth on a textile. Apart from the aesthetic benefits of clean fabric, the major reason for scouring is to improve the extent and uniformity of absorbency for subsequent processes, especially dyeing. Scouring generally takes place using mild alkalinity and surfactants as wetting agents, such as alkylbenzenesulfonate and alkylphenol ethoxylates. It is noted that scouring is particularly important with natural fibers which contain much more extraneous matter than synthetic fibers. For example, cotton, requires high alkalinity scouring, which swells the fibers, allowing access to the lumen and removing soil from the surface.

(4) "Bleaching" involves bleaching of the various types of textiles with a peroxide bleaching compound. Suitable peroxide compounds are water soluble peroxides, particularly alkali metal peroxides, preferably sodium peroxide, and hydrogen peroxide, the latter being particularly preferred. The peroxide bleaching is carried out in an alkaline medium. To achieve the alkaline conditions, it is advantageous to use an alkali metal hydroxide, preferably potassium or sodium hydroxide.

(5) "Mercerising" is used to swell cotton fibers in order to increase their lustre, strength, and dyeability. Generally, a cold solution of sodium hydroxide is used; however, hot mercerising techniques and the use of acids, such as cresylic acid along with a cosolvent, may also be employed.

(6) "Dyeing" involves the application of a solution or a dispersion of a dye to a textile followed by some type of fixation process. The dye solution or dispersion is almost always an aqueous medium, and a major objective of the fixation step is to ensure that the colored textile exhibits satisfactory fastness to subsequent treatment in aqueous wash liquors.

Suitable textiles to be treated with the hydrophobically modified polymer of the invention are, for example, cotton, denim, polyacrylics, polyamides, polyesters, polyolefins, rayons, wool, linen, jute, ramie, hemp, sisal, regenerated cellulosic fibers such as rayon or cellulose acetate, leather, and combinations thereof. The textiles can be in a variety of forms, for example, yarn, tops, woven, knitted, plush, carpets, and finished garments.

The concentration of the hydrophobically modified polymer in a textile manufacturing or treating process is preferably from about 0.001 to about 50 weight percent, based on the weight of the solution or dispersion containing the hydrophobically modified polymer which is used in the textile process. More preferably, the hydrophobically modified polymer is present in an amount of from 0. 1 to 25 weight percent, most preferably from 1 to 10 weight percent.

The hydrophobically modified polymer has a hydrophilic backbone and at least one hydrophobic moiety. The hydrophilic backbone may be linear or branched and is prepared from at least one ethylenically unsaturated hydrophilic monomer selected from unsaturated acids preferably $C_1$–$C_6$ acids, amides, ethers, alcohols, aldehydes, anhydrides, ketones and esters; polymerizable hydrophilic cyclic monomers; and non-ethylenically unsaturated polymerizable hydrophilic monomers selected from glycerol and other polyhydric alcohols. Combinations of hydrophilic monomers may also be used. Preferably the hydrophilic monomers are sufficiently water soluble to form at least a 1% by weight solution in water.

Preferably the ethylenically unsaturated hydrophilic monomers are mono-unsaturated. Examples of ethylenically unsaturated hydrophilic monomers are, for example, acrylic acid, methacrylic acid, ethacrylic acid, alpha-chloro-acrylic acid, alpha-cyano acrylic acid, beta methyl-acrylic acid (crotonic acid), alpha-phenyl acrylic acid, beta-acryloxy propionic acid, sorbic acid, alpha-chloro sorbic acid, angelic acid, cinnamic acid, p-chloro cinnamic acid, beta-styryl acrylic acid (1-carboxy4-phenyl butadiene-1,3), itaconic acid, maleic acid, citraconic acid, mesaconic acid, glutaconic acid, aconitic acid, fumaric acid, tricarboxy ethylene, 2-acryloxypropionic acid, 2-acrylamido-2-methyl propane sulfonic acid, vinyl sulfonic acid, vinyl phosphonic acid, 2-hydroxy ethyl acrylate, tri methyl propane triacrylate, sodium methallyl sulfonate, sulfonated styrene, allyloxybenzenesulfonic acid, dimethylacrylamide, dimethylaminopropylmethacrylate, diethylaminopropylmethacrylate, vinyl formamide, vinyl acetamide, polyethylene glycol esters of acrylic acid and methacrylic acid and itaconic acid, vinyl pyrrolidone, vinyl imidazole, maleic acid, and maleic anhydride. Combinations of ethylenically unsaturated hydrophilic monomers may also be used. Preferably, the ethylenically unsaturated hydrophilic monomer is selected from acrylic acid, maleic acid, and itaconic acid.

The polymerizable hydrophilic cyclic monomers may have cyclic units that are either unsaturated or contain groups capable of forming inter-monomer linkages. In linking such cyclic monomers, the ring-structure of the monomers may either be kept intact, or the ring structure may be disrupted to form the backbone structure. Examples of cyclic units are sugar units such as saccharides and glucosides, cellulose ethers, and alkoxy units such as ethylene oxide and propylene oxide.

The hydrophilic backbone of the hydrophobically modified polymer may optionally be substituted with one or more amino, amine, amide, sulfonate, sulfate, phosphonate, hydroxy, carboxyl or oxide groups. The hydrophilic backbone of the polymer may also contain small amounts of relatively hydrophobic units, for example, units derived from polymers having a solubility of less than 1 g/l in water, provided that the overall solubility of the polymer in water at ambient temperature and at a pH of 3.0 to 12.5 is more than 1 g/l, more preferably more than 5 g/l, and most preferably more than 10 g/l. Examples of relatively water insoluble monomers are vinyl acetate, methyl methacrylate, ethyl acrylate, ethylene, propylene, hydroxy propyl acetate, styrene, octyl methacrylate, lauryl methacrylate, stearyl methacrylate, behenyl methacrylate.

The hydrophobic moieties are linked to the hydrophilic backbone by any possible chemical link, although the following types of linkages are preferred:

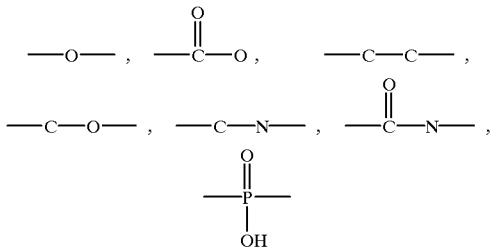

Preferably the hydrophobic moieties are part of a monomer unit which is incorporated in the polymer by copolymerising hydrophobic monomers and the hydrophilic monomers making up the backbone of the polymer. The hydrophobic moieties preferably include those which when isolated from their linkage are relatively water insoluble, i.e. preferably less than 1 g/l more preferred less than 0.5 g/l, most preferred less than 0.1 g/l of the hydrophobic monomers, will dissolve in water at ambient temperature and a pH of 3 to 12.5.

Preferably the hydrophobic moieties are selected from siloxanes, aryl sulfonate, saturated and unsaturated alkyl moieties optionally having sulfonate end groups, wherein the alkyl moieties have from 5 to 24 carbon atoms, preferably from 6 to 18, most preferred from 8 to 16 carbon atoms, and are optionally bonded to the hydrophilic backbone by means of an alkoxylene or polyalkoxylene linkage, for example a polyethoxy, polypropoxy or butyloxy (or mixtures of same) linkage having from 1 to 50 alkoxylene groups. Alternatively the hydrophobic moiety may be composed of relatively hydrophobic alkoxy groups, for example butylene oxide and/or propylene oxide, in the absence of alkyl or alkenyl groups.

Examples of hydrophobic monomers include styrene, α-methyl styrene, 2-ethylhexyl acrylate, octylacrylate, lauryl acrylate, stearyl acrylate, behenyl acrylate, 2-ethylhexyl methacrylate, octylmethacrylate, lauryl methacrylate, stearyl methacrylate, behenyl methacrylate, 2-ethylhexyl acrylamide, octylacrylamide, lauryl acrylamide, stearyl acrylamide, behenyl acrylamide, propyl acrylate, butyl acrylate, pentyl acrylate, hexyl acrylate, 1-vinyl naphthalene, 2-vinyl naphthalene, 3-methyl styrene, 4-propyl styrene, t-butyl styrene, 4-cyclohexyl styrene, 4-dodecyl styrene, 2-ethyl-4-benzyl styrene, and 4-(phenylbutyl) styrene. Combinations of hydrophobic monomers may also be used.

Alternatively, the hydrophobic moiety may be introduced into the polymer in the form of a chain transfer agent. The chain transfer agent has from 1 to 24 carbon atoms, preferably 1 to 14 carbon atoms, more preferably 3 to 12 carbon atoms. The chain transfer agent is selected from mercaptans or thiols, amines and alcohols. A combination of chain transfer agents can also be used. Mercaptans useful in this invention are organic mercaptans which contain at least one —SH or thiol group and which are classified as aliphatic, cycloaliphatic, or aromatic mercaptans. The mercaptans can contain other substituents in addition to hydrocarbon groups, such substituents including carboxylic acid groups, hydroxyl groups, ether groups, ester groups, sulfide groups, amine groups and amide groups. Suitable mercaptans are, for example, methyl mercaptan, ethyl mercaptan, butyl mercaptan, mercaptoethanol, mercaptopropanol, mercaptobutanol, mercaptoacetic acid, mercaptopropionic acid, thiomalic acid, benzyl mercaptan, phenyl mercaptan, cyclohexyl mercaptan, 1-thioglycerol, 2.2'-dimercaptodiethyl ether, 2,2'-dimercaptodipropyl ether, 2,2'-dimercaptodiisopropyl ether, 3,3'-dimercaptodipropyl ether, 2,2'-dimercaptodiethyl sulfide, 3,3'-dimercaptodipropyl sulfide, bis(beta-mercaptoethoxy) methane, bis(beta-mercaptoethylthio)methane ethanedithio-1,2, propanedithiol-1,2, butanedithiol-1,4,3,4-dimercaptobutanol-1, trimethylolethane tri(3-mercaptopropionate), pentaerythritol tetra(3-mercaptopropionate), trimethylolpropane trithioglycolate, pentaerythritol tetrathio-glycolate, octanethiol, decanethiol, dodecanethiol, and octadecylthiol. Preferred mercaptan chain transfer agents include 3-mercaptopropionic acid and dodecanethiol.

Suitable amines which are useful as chain transfer agents are, for example, methylamine, ethylamine, isopropylamine, n-butylamine, n-propylamine, iso-butylamine, t-butylamine, pentylamine, hexylamine, benzylamine, octylamine, decylamine, dodecylamine, and octadecylamine. A preferred amine chain transfer agent is isopropyl amine and docylamine.

Suitable alcohols which are useful as chain transfer agents are, for example, methanol, ethanol, isopropanol, n-butanol, n-propanol, iso-butanol, t-butanol, pentanol, hexanol, benzyl alcohol, octanol, decanol, dodecanol, and octadecanol. A preferred alcohol chain transfer agent is isopropanol and dodecanol.

The hydrophobically modified polymers are prepared by processes known in the art such as disclosed in U.S. Pat. No. 5,147,576. Preferably, the hydrophobically modified polymers are prepared using conventional aqueous polymerization procedures, but employing a process wherein the polymerization is carried out in the presence of a suitable cosolvent and wherein the ratio of water to cosolvent is carefully monitored so as to maintain the ratio of water to cosolvent to keep the polymer, as it forms, in a sufficiently mobile condition and to prevent unwanted homopolymerization of the hydrophobic monomer and subsequent undesired precipitation thereof.

In one embodiment, the hydrophobically modified polymer has Structure (I):

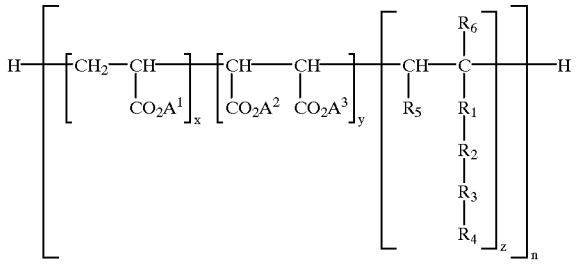

wherein z is 1; (x+y): z is from 0.1:1 to 1,000:1, preferably from 1:1 to 250:1; in which the monomer units may be in random order; y is from 0 to a maximum equal to the value of x; and n is at least 1; $R_1$ is selected from the group consisting of —CO—O—, —O—, —O—CO—, —$CH_2$—, —CO—NH—, —$CH_2$—O—, and —$CH_2$—O—CO—, or is absent; $R_2$ is from 1 to 50 independently selected alkyleneoxy groups, preferably ethylene oxide or propylene oxide groups, or is absent, provided that when $R_3$ is absent and $R_4$ is H or contains no more than 4 carbon atoms, then $R_2$ is an alkyleneoxy group with at least 3 carbon atoms; $R_3$ is a phenylene linkage, or is absent; $R_4$ is selected from the group consisting of H, $C_1$–$C_{24}$ alkyl, $C_1$–$C_{24}$ alkyl sulfonate, and $C_2$–$C_{24}$ alkenyl group, provided that a) when $R_1$ is —O—CO— or —CO—O— or —CO—NH—, $R_2$ and $R_3$ are absent and $R_4$ has at least 5 carbon atoms; b) when $R_2$ is absent, $R_4$ is not H and when $R_3$ is absent, then $R_4$ has at least 5 carbon atoms; $R_5$ is H or —$COOA^4$; $R_6$ is H or a $C_1$–$C_4$ alkyl; and $A^1$, $A^2$, $A^3$, and $A^4$ are independently selected from the group consisting of H, alkali metals, alkaline earth metals, ammonium bases, amine bases, $C_1$–$C_4$ alkyl, and $(C_2H_4O)_t$ H, wherein t is from 1–50.

In one embodiment, the hydrophobically modified polymer has Structure (II):

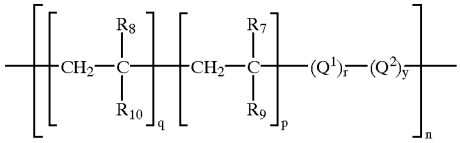

wherein $Q^2$ has the Structure (IIa):

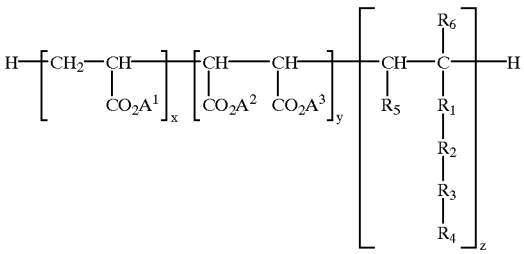

wherein $Q^1$ is a multifunctional monomer, allowing the branching of the polymer, wherein the monomers of the polymer may be connected to $Q^1$ in any direction or order, therewith possibly resulting in a branched polymer, preferably $Q^1$ is selected from trimethyl propane triacrylate (TMPTA), methylene bisacrylamide or divinyl glycol; r is 1; and (x+y+p+q+r):z is from 0.1:1 to 1,000:1, preferably from 1:1 to 250:1; in which the monomer units may be in random order; and preferably either p and q are zero, or r is zero; $R_7$ and $R_8$ are independently —$CH_3$ or —H; $R_9$ and $R_{10}$ are independently substituent groups selected from the group consisting of amino, amine, amide, sulfonate, sulfate, phosphonate, phosphate, hydroxy, carboxyl and oxide groups, preferably —$SO_3Na$, —CO—O—$C_2H_4$—$OSO_3Na$, —CO—O—NH—$C(CH_3)_2$—$SO_3Na$, —CO—$NH_2$, —O—CO—$CH_3$, and —OH.

In one embodiment, the hydrophobically modified polymer has Structure

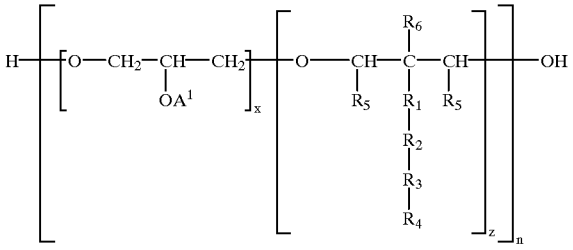

(III):

wherein z=1; x:z is from 0.1:1 to 1,000:1, preferably from 1:1 to 250:1; n is 1; $A^1$ may be a branching point wherein other molecules of Structure (III) are attached.

Examples of molecules having Structure (III) are hydrophobically modified polyglycerol ethers or hydrophobically modified condensation polymers of polyglycerol and citric acid anhydride.

In one embodiment, the hydrophobically modified polymer has Structure (IV):

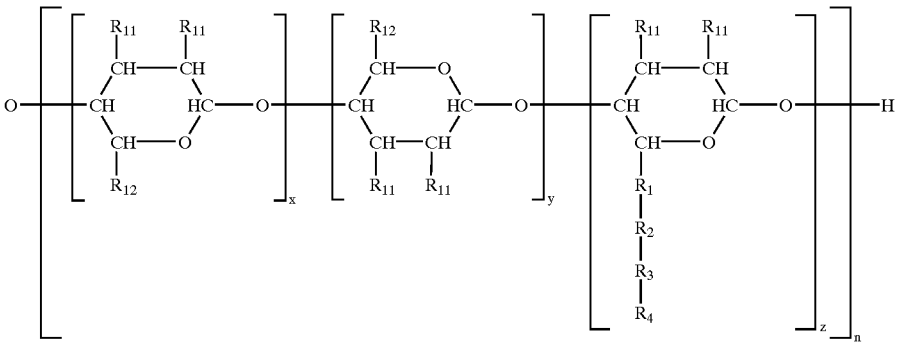

wherein (x+y):z is from 0.1:1 to 1,000:1, preferably from 1:1 to 250:1; wherein the monomer units may be in random order; $R_{11}$ is selected from the group consisting of —OH, —NH—CO—$CH_3$, —$SO_3A^1$ and —$OSO_3A^1$; $R_{12}$ is selected from the group consisting of —OH, —$CH_2OH$, —$CH_2OSO_3A^1$, $COOA^1$, and —$CH_2$—$OCH_3$.

Examples of molecules having Structure (IV) are hydrophobically modified polydextran, -dextran sulfonates, -dextran sulfates and lipoheteropolysaccharides.

In one embodiment, the hydrophobically modified polymer has Structure (V):

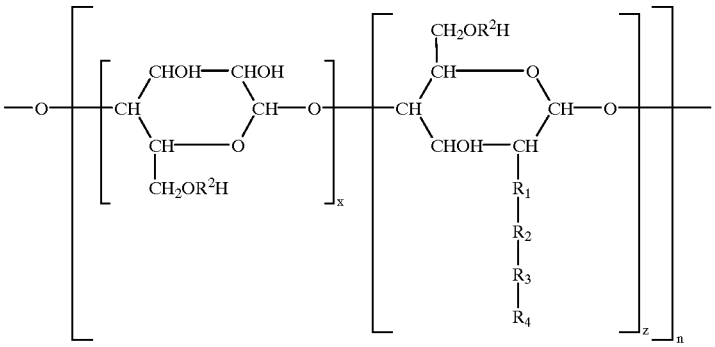

wherein z, n and $R_1$–$R_6$ are as defined above for Structure (I); and x is as defined for Structure (III).

In one embodiment, the hydrophobically modified polymers are hydrophobically modified condensation polymers of -hydroxy acids. Examples of suitable polymer backbones are polytartronate, polycitrate, polyglyconate, and mixtures thereof. In another embodiment, the hydrophobically modified polymers are hydrophobically modified polyacetals.

It is within the scope of the invention that a sample of hydrophobically modified polymers may contain full salt polymers ($A^1$–$A^4$ all other than hydrogen), full acid polymers ($A^1$–$A^4$ all hydrogen) and part-salt polymers (one or more of $A^1$–$A^4$ hydrogen and one or more other than hydrogen).

The salts of the hydrophobically modified polymers may be formed with any organic or inorganic cation defined for $A^1$–$A^4$ and which is capable of forming a water-soluble salt with a low molecular weight carboxylic acid. Preferred are the alkali metal salts, especially of sodium or potassium.

In one embodiment, the hydrophobically modified polymer is used to prevent backstaining of denim during the stonewashing of denim articles. While not wishing to be bound by any particular theory, the present inventors believe that the hydrophobically modified polymer bind with indigo dye or indigo cellulase complex and prevents the indigo dye and/or indigo cellulase complex from redepositing onto the denim.

In one embodiment, where the hydrophobically modified polymer is used at the steps of desizing, scouring and bleaching textiles, not only a hydrogen peroxide-stabilized effect but also a high decomposition-promoting effect can be obtained, and an abnormal decomposition by metal ions such as iron, copper and calcium ions can be controlled. Furthermore, a good dispersibility is given to decomposition products, for example in the case of polyester the redeposition of polyester trimers has a deleterious effect on the overall dying, and thus, it is neceassary to use the hydrophobically modified polymers to suspend the trimers and keep them from redepositing on the fabric.

In one embodiment, where the hydrophobically modified polymer is used for the mercerization of cotton or flax, the hydrophobically modified polymer can be incorporated into a mercerizing bath or soaping bath of a yarn mercerizing machine or a knitted or woven fabric mercerizing machine. Since the alkali resistance of the hydrophobically modified polymer is good, a decomposition or separation of the hydrophobically modified polymer per se does not occur, the deposition of scales on a roll or the like is prevented, and the dispersibility of the bath is improved.

The hydrophobically modified polymer complexes heavy metal ions in the manufacturing or treating of textiles. For example, the hydrophobically modified polymers help stabilize hydrogen peroxide in the bleaching process, reduce scale and prevent deposition of heavy metal ions such as iron, calcium and magnesium during the scouring, desizing, mercerising, and bleaching processes. In addition, the hydrophobically modified polymers prevent redeposition of particulate soils onto the textiles.

Furthermore, in the dyeing process, the hydrophobically modified polymers disperse direct and dispersed dyes, and suspend unfixed dyes, and thus, provide a consistent and level dyeing of textiles. An additional advantage is that the hydrophobically modified polymers complex salts, such as calcium, magnesium and iron salts, during the dyeing process which prevents the salts from depositing on the textiles and causing blemishes, or precipitating the dyes out of solution which reduces the efficiency of the dyes.

The following nonlimiting examples illustrate further aspects of the invention.

EXAMPLE 1

Preparation of Hydrophobically Modified Polymer Containing 33.3 Mole % Acrylic Acid and 66.7 Mole % Styrene (Structure I).

An initial charge of 140 g of deionized water and 240 g of isopropyl alcohol was added to a 1 liter glass reactor fitted with a lid having inlet ports for an agitator, water cooled condenser and for the addition of monomer and initiator solutions. The reactor contents were heated to reflux (approximately 86° C.). At reflux, continuous additions of 103 g of acrylic acid, 297 g of styrene and 1 g of dodecylmercaptan (DDM), were added to the reactor concurrently with stirring over a period of 3 hours. During the same time period and for 30 additional minutes, the following initiator solutions were added to the reactor:

| Initiator Solution #1 | |
|---|---|
| t-butyl hydroperoxide | 40 g |
| Isopropyl alcohol | 20 g |
| Deionized water | 20 g |
| **Initiator Solution #2** | |
| sodium formaldehyde sulphoxylate | 16 g |
| Deionized water | 80 g |

At the end of the initiator addition, a 47% aqueous sodium hydroxide solution (100 g) was added to yield a polymer solution having a final pH of approximately 7 to 8. The reaction temperature was maintained at reflux for a further 1 hour to eliminate any unreacted monomer.

After the 1 hour hold the alcohol cosolvent was removed from the polymer solution by azeotropic distillation under vacuum. During the distillation, deionized water was added to the polymer solution to maintain a reasonable polymer viscosity. The aqueous solution of the hydrophobically modified polymer was cooled to less than 30° C.

EXAMPLE 2

Preparation of Hydrophobically Modified Polymer Containing 60 Mole % Acrylic Acid and 40 Mole % Styrene.

An initial charge of 86.4 g of deionized water, 79.2 g of isopropyl alcohol, and 0.042 grams of ferrous ammonium sulfate were added to a 1 liter glass reactor. The reactor contents were heated to reflux (approximately 84° C.).

At reflux, continuous additions of 64.5 g of acrylic acid, 62.1 g of styrene, 0.1 g of dodecylmercaptan, were added over a period of 3.5 hours. The initiator and chain transfer solutions were added at the same time as the above described monomer solution over a period of 4 hours and 3.25 hours, respectively.

| Initiator solution | |
|---|---|
| Sodium persulfate | 5.72 g |
| Water | 14.0 g |
| Hydrogen peroxide 35% | 16.7 g |
| **Chain transfer solution** | |
| 3-mercapto propionic acid, 99.5% | 4.9 g |
| water | 21.8 g |

After adding the initiator and chain transfer solutions, the reaction temperature was maintained at about 88° C. for one hour. The alcohol cosolvent was removed from the polymer solution by azeotropic distillation under vacuum. During the distillation, a mixture of 144 g of deionized water and 64.1 g of a 50% sodium hydroxide solution was added to the polymer solution. A small amount of ANTIFOAM 1400 (0.045 g) was added to suppress any foam generated during distillation. Approximately, 190 g of a mixture of water and isopropyl alcohol were distilled off. After distillation was completed, 25 g of water was added to the reaction mixture which was cooled to obtain a yellowish amber solution.

EXAMPLE 3

Preparation of Hydrophobically Modified Polymer Containing 96.1 Mole % Acrylic Acid and 3.9 Mole % Laurylmethacrylate.

An initial charge of 190 g of deionized water and 97.1 g of isopropyl alcohol were added to a 1 liter glass reactor. The reactor contents were heated to reflux (approximately 82° C.–84° C.). At reflux continuous additions of 105 g of acrylic acid, and 15.0 g of laurylmethacrylate were added to the reactor concurrently over a 3 hour period of time with stirring. Concurrently, an initiator solution containing 15.9 g of sodium persulfate and 24.0 g of water was added over a period of 4 hours.

The reaction temperature was maintained at 82°C.–85° C. for an additional hour. The alcohol cosolvent was removed from the polymer solution by azeotropic distillation under vacuum. During the half way point of the distillation (when approximately 100 g of distillate is producted), 48 g of hot water was added to the polymer solution to maintain a reasonable polymer viscosity. A small amount of ANTIFOAM 1400 (0.045 g) was added to suppress any foam that may be generated during distillation. Approximately, 200 g of a mixture of water and isopropyl alcohol was distilled off. The distillation was stopped when the isopropyl alcohol level in the reaction product was less than 0.3 weight percent.

The reaction mixture was cooled to less than 40° C. and 45 g of water and 105.8 g of a 50% NaOH was added to the reaction mixture with cooling while maintaining a temperature of less than 40° C. to prevent hydrolysis of the laurylmethacrylate. The final product was an opaque viscous liquid.

EXAMPLE 4

Evaluation of Soil Suspension Properties.

The hydrophobically modified polymers prepared in Examples 2 and 3 were evaluated in a textile treating composition for their ability to suspend soils such as dirt and oils during the scouring process as compared to a textile treating composition without the hydrophobically modified polymer. The soil suspension test was conducted in a terg-o-tometer using three 4×4.5" cotton swatches and three 4×4.5" EMPA 213 (polycotton swatches available from Test Fabrics). Five 4×4" polycotton swatches were used as ballast. The wash cycle was 10 minutes using 1.4 g/l of the textile treating composition (listed below) and 150 ppm hardness water with a Ca to Mg ratio of 2:1. The soil used was 0.3 g/L rose clay, 0.16 g/L bandy black clay and 0.9 g/L of an oil blend (70% vegetable oil and 30% mineral oil). The polymers were dosed at 1 or 2 percent of the weight of the textile treating composition. The rinse cycle was 3 minutes using 150 ppm hardness water with a Ca to Mg ratio of 2:1. A total of three wash, rinse, and dry cycles were carried out. The drying was done in a tumble dryer on medium setting . The L a b values before the first cycle and after the third cycle was measured as $L_1$, $a_1$, $b_1$ and $L_2$, $a_2$, $b_2$ respectively.

$$\Delta E=[(L_1-L_2)^2+(a_1-a_2)^2+(b_1-b_2)^2]^{0.5}$$

The textile treating composition was prepared as follows: 100 g of Zeolite A (Valfor 100 from Crossfield), 40 g of sodium carbonate, 100 g of a 40% sodium silicate solution, 16 g of NEODAL 25-7 from Shell Chemical, 90 g of dodecylbenzene sodium sulfonate (COLONIAL 1240 from Colonial Chemical) and 176.8 grams of sodium sulfate was mixed together using a mortar and pestle till a free flowing homogenous powder was obtained. The test results are summarized in Table 1.

TABLE I

| Soil Suspension Test | | | | |
|---|---|---|---|---|
| Polymer | ΔE for cotton | Ave ΔE for cotton | ΔE for polycotton | Ave ΔE for polycotton |
| Blank | 3.22 | | 1.52 | |
| | 3.24 | 3.15 | 1.53 | 1.52 |
| | 3.0 | | 1.51 | |
| Polymer of Example 2 at 1 wt % of textile treating composition | 1.48 | | 0.54 | |
| | 1.28 | 1.33 | 0.69 | 0.62 |
| | 1.25 | | 0.62 | |
| Polymer of Example 2 at 2 wt % of textile treating composition | 1.27 | | 0.65 | |
| | 1.39 | 1.32 | 0.72 | 0.71 |
| | 1.30 | | 0.75 | |
| Polymer of Example 3 at 1 wt % of textile treating composition | 1.52 | | 0.66 | |
| | 1.81 | 1.66 | 0.71 | 0.69 |
| | 1.66 | | 0.71 | |
| Polymer of Example 3 at 2 wt % of textile treating composition | 1.30 | | 0.66 | |
| | 1.29 | 1.26 | 0.73 | 0.70 |
| | 1.18 | | 0.70 | |

The test results in Table I clearly show that the textile treating composition containing the hydrophobically modified polymers prepared in Examples 2 and 3 suspend significantly more clays (polar non-organic soils) and oils (non-polar organic soils) as compared to the textile treating composition without the hydrophobically modified polymer.

EXAMPLE 5

Evaluation of Hydrophobically Modified Polymers for Backstaining of Cotton.

The hydrophobically modified polymers prepared in Examples 2 and 3 were evaluated in a denim stonewashing process. The stonewashing process was carried out in a terg-o-tometer using a 4×4 inch piece of denim treated with 2 weight percent cellulase enzyme. A 4×4 piece of white cotton fabric was added to the test to pick up any indigo dye released into solution. The pH of the solution was buffered to 4 to 5 using acetic acid. The hydrophobically modified polymers of Examples 2 and 3 were added to 1 wt % of the treatment bath. The test was run for 20 minutes at 120° F. and 120 rpm. The high rpm was used to simulate the strong mechanical forces generated during the stonewashing process.

At the end of the test, the swatches treated with the hydrophobically modified polymers prepared in Examples 2 and 3 were determined to have less indigo dye deposited on the white anti-redeposition swatch as well as on the back side of the cotton swatch.

EXAMPLE 6

Evaluation of Calcium Binding Properties.

The calcium binding properties of the hydrophobically modified polymer prepared in Example 2 was evaluated in a Hampshire binding test according to the following procedure:

(1) Prepare a 0.25M calcium acetate solution.

(2) Prepare a 2 weight percent polymer solution based on solids of the hydrophobically modified polymer of Example 2.

(3) Prepare a 2 weight percent sodium carbonate solution.

(4) Mix 50 grams of the 2 weight percent polymer solution with 10 ml of the 2 weight percent sodium carbonate solution. The volume was adjusted to 100 ml with water. A control sample was prepared without a polymer.

(5) The mixture containing polymer and sodium carbonate was titrated with the 0.25 M calcium acetate solution until the mixture became permanently cloudy. The results of the titration are summarized in Table II.

TABLE II

| Polymer | ml of 0.25 M Calcium acetate solution | Calcium binding mg $CaCO_3$/g polymer |
|---|---|---|
| Control | 0 | 0 |
| Polymer of Example 2 | 9.0 | 225 |

The test results in Table II clearly shows that the hydrophobically modified polymer prepared in Example 2 exhibits substantial calcium binding properties as compared to a control sample without a polymer.

EXAMPLE 7

Synthesis of Hydrophobically Modified Polyacrylic Acid with a $C_{12}$ Chain Transfer Agent.

524.8 g of water and 174 g of isopropyl alcohol were heated in a reactor to 85° C. A mixture of 374 g of acrylic acid and 49 g of n-dodecylmercaptan were added to the reactor over a period of three hours. After addition was completed, 65.3 g of acrylic acid was added over a period of 30 minutes to the reactor. At the same time, a solution of 17.5 g of sodium persulfate in 175 g of water was added to the reactor over a period of four hours. The temperature of the reactor was maintained at 85–95° C. for one hour, after which time, 125 g of water, 51 g of a 50% NaOH solution, and 0.07 g of ANTIFOAM 1400, available from Dow Chemical Company, were added to the reactor. The reaction mixture was distilled to remove the isopropyl alcohol. Approximately 300 g of a mixture of isopropyl alcohol and water were distilled off. The reaction mixture was cooled to room temperature and 388 g of a 50% NaOH solution was added.

EXAMPLE 8

Evaluation of Soil Suspension Properties.

The hydrophobically modified polyacrylic acid with a $C_{12}$ chain transfer agent prepared in Example 7 was evaluated in a textile treating composition for soil suspension properties and compared to a textile treating composition without the polymer. The test was conducted in a terg-o-tometer using three 4×4.5" cotton swatches and three 4×4.5" EMPA 213 (polycotton swatches available from Test Fabrics). Five 4×4" polycotton swatches were used as ballast. The wash cycle was 10 minutes using 0.9 g/L of textile treating composition (listed below) and 150 ppm hardness water with a Ca to Mg ratio of 2:1. The soil used 0.46 g/L bandy black clay and 0.9 g/L of an oil blend (70% vegetable oil and 30% mineral oil). The polymer and copolymers were dosed at 1 weight percent of the textile treating composition weight. The rinse cycle was 3 minutes using 150 ppm hardness water with a Ca to Mg ratio of 2:1. A total of 3 cycles were carried out and the swatches were dried in a tumble dryer on medium setting. The L a b values before the first cycle and after the third cycle was measured as $L_1$, $a_1$, $b_1$ and $L_2$, $a_2$, $b_2$ respectively.

$$\Delta E=[(L_1-L_2)^2+(a_1-a_2)^2+(b_1-b_2)^2]^{0.5}$$

The textile treating composition was prepared as follows: 100 g of Zeolite A (Valfor 100 from ), 40 g of sodium carbonate, 100 g of a 40% sodium silicate solution, 16 g of Neodal 25-7 from Shell, 90 g of dodecylbenzene sodium sulfonate (ACS 1240 from Colonial Chemical) and 176.8 grams of sodium sulfate was mixed together using a mortar and pestle till a free flowing homogenous powder was obtained. The test results are summarized in Table III.

TABLE III

| | Soil suspension Test | | | |
|---|---|---|---|---|
| Polymer | ΔE for cotton | Ave ΔE for cotton | ΔE for polycotton | Ave ΔE for polycotton |
| Blank | 3.22 | | 1.52 | |
| | 3.24 | 3.15 | 1.53 | 1.52 |
| | 3.0 | | 1.51 | |
| Polymer of | 1.79 | | 0.79 | |
| Example 7 | 1.70 | 1.72 | 0.85 | 0.84 |
| | 1.69 | | 0.88 | |

The test results in Table III clearly show that the hydrophobically modified polyacrylic acid with a $C_{12}$ chain transfer agent have superior soil suspension properties as compared to a textile treating composition without a hydrophobically modified polymer.

While the invention has been described with particular reference to certain embodiments thereof, it will be understood that changes and modifications may be made by those of ordinary skill within the scope and spirit of the following claims.

What is claimed is:

1. A method to prevent the backstaining of denim during a stonewashing process comprising treating the denim with a solution or dispersion of a hydrophobically modified polymer having a hydrophilic backbone and at least one hydrophobic moiety, wherein said hydrophilic backbone is prepared from at least one monomer selected from the group consisting of ethylenically unsaturated hydrophilic monomer selected from the group consisting of unsaturated amide, ether, and combinations thereof, wherein said hydrophilic backbone is optionally substituted with one or more amino, amine, amide, sulfonate, sulfate, phosphonate, hydroxy, carboxyl or oxide groups;

wherein said hydrophobic moiety is prepared from at least one hydrophobic monomer, said hydrophobic monomer is selected from the group consisting of a hydrophobic alkoxygroup and combinations thereof, wherein said hydrophobically modified polymer is present in an amount of from 0.001 to 50 weight percent, based on the total weight of the solution or dispersion.

2. The textile process according to claim 1 wherein the hydrophobically modified polymer is present in an amount of from 0.1 to 25 weight percent.

3. The textile process according to claim 2 wherein the hydrophobically modified polymer is present in an amount of from 0.1 to 1 weight percent.

* * * * *